United States Patent [19]

Rose

[11] 4,171,661

[45] Oct. 23, 1979

[54] GUITAR TREMOLO METHOD AND APPARATUS

[76] Inventor: Floyd D. Rose, 1195 Valley Rd., Reno, Nev. 89512

[21] Appl. No.: 756,190

[22] Filed: Jan. 3, 1977

[51] Int. Cl.[2] ..... G10D 3/04; G10D 3/12

[52] U.S. Cl. ..... 84/313; 84/297 R; 84/307; 84/314 N

[58] Field of Search ..... 84/297 R, 298, 299, 84/307, 312 P, 313, 314, 214

[56] References Cited

U.S. PATENT DOCUMENTS

| | | | |
|---|---|---|---|
| 118,353 | 8/1871 | Faas | 84/214 |
| 462,519 | 11/1891 | Van Dusen | 84/214 |
| 509,414 | 11/1893 | Weber | 84/214 |
| 2,214,957 | 9/1940 | Farginele | 84/314 |
| 2,741,146 | 4/1956 | Fender | 84/313 |
| 3,196,729 | 7/1965 | Burns et al. | 84/171 |

*Primary Examiner*—Lawrence R. Franklin
*Attorney, Agent, or Firm*—Herbert C. Schulze

[57] ABSTRACT

This is a method and apparatus for performing the method, for the use of tremolo devices complimented by string restraining assemblies for guitars which are designed in such manner that the tremolo device can be used without altering the basic tuning when the tremolo device returns to the normal, inactive, position. The method and device incorporate the use of a tremolo device base plate anchoring means anchoring the tremolo device base plate to the face of the guitar at a tilt point in such manner that there is no movement allowed other than the normally desired tremolo tilting movement. This is accomplished by utilization of special anchoring means, string restraining assemblies, and means to return the tremolo device to its original starting position when being inactivated.

3 Claims, 8 Drawing Figures

GUITAR TREMOLO METHOD AND APPARATUS

CROSS REFERENCE TO RELATED PATENT APPLICATIONS

There are no patent applications filed by me which are related to this patent application.

BACKGROUND OF THE INVENTION

1. Field of the Invention

This invention is in the general field of musical instruments, is more particularly directed to a guitar, and even more particularly is directed to a method and means for associating a tremolo device with a guitar and with guitar strings in such manner that the tremolo device returns to its original position when it is inactivated, and the strings do not move, and remain in tune.

1. Description of the Prior Art

There are many tremolo devices known to those skilled in the guitar art. The tremolo devices take a number of different configurations. All tremolo devices, of whatever structure, have the common fault that immediately after use of the device, the guitar will be out of tune as compared to the tuning which existed immediately prior to the use of the tremolo device.

I have invented and developed a method, and apparatus for performing the method, wherein a tremolo device of the type which utilizes a base plate is so anchored to the guitar, and the strings are so restrained at both the bridge and the nut end, that the tremolo device can be used, and when inactivated returns to the original position retaining the original tune of the strings. In this sense, there is no prior art.

SUMMARY OF THE INVENTION

Guitars are frequently fitted with, or originally include, a device known as a "tremolo" device. The purpose of the tremolo device is to allow a guitarist to alter an existing string tone, or existing string tones, by an increase or decrease of string tension. The tone changes are impressive and useful to a guitarist, but, when tremolo devices heretofore known are utilized, the strings of the guitar normally will not return to the same exact tension over the playing area as which they were previously set, and therefore the guitar is out of tune after the tremolo device has been used.

Basically the tremolo device must be anchored to the face of the guitar, and the tremolo device includes the bridge end of the strings. The other end of the strings is at the nut, which is near the position where the strings may be tightened or loosened by customary means.

Normally, all tremolo devices will have movement, frequently of a complex nature, with relation to the face of the guitar. Particularly those devices which are so designed that they are utilizing a tremolo device base plate, allow for considerable complex movement, such as sliding or pivoting movement with relation to the original position. Additionally, the strings will actually move when the device is used and such movement will be longitudinal over both the nut and the bridge.

In view of the problems and circumstances as heretofore outlined, I have designed a base plate for a tremolo device which is anchored in such manner that it must always return to the position in which it was located prior to activation, and after each activation. A positive activating force must be utilized in order to have it in any other position.

Additionally, I have incorporated a combination of string restraining assembly means at both the bridge and the nut end in such manner that the strings cannot slide across either the bridge or the nut during the utilization of the tremolo device. In accomplishing this new and useful tremolo device method and arrangement, including the string restraining arrangement, I have primarily concerned myself with, and have accomplished, a means by which the full tilting desired by the tremolo device may be accomplished about an anchor position consisting of an anchor means which allows tilting, yet is so restrained as to return to a fixed anchor position when the tremolo is not under pressure. In one preferred embodiment, I have utilized a pair of tapered slots at opposite sides of the tremolo device together with a pair of specially constructed screws, with shoulders, which are affixed to the guitar face. I have associated this with a spring arrangement within the guitar which returns the tremolo device base plate to its starting position immediately in each instance after use.

In connection with the base plate, I have provided a bridge with restraining arrangements for the strings so that they cannot slide over the bridge, and this restraining arrangement is directly associated with the tremolo device face plate.

At the nut end of the guitar, I have also provided a restraining arrangement for the strings so that the strings cannot slide across the nut.

In one preferred embodiment, which will be described, I have utilized blocks of rigid material, such as metal, or the like, which clamp the strings in position both at the tremolo device, and at the nut.

By the combination heretofore referenced, I have now accomplished the end result of maintaining the strings at all times in a relatively locked position at both the tremolo device end (the bridge end) and at the nut end. The base plate itself is so arranged with minimum friction mounting and return means such that the objects desired are all accomplished.

It is an object of this invention to provide a method by which a guitar can be used with a tremolo device wherein there is no distortion of pre-tremolo use tuning of the guitar as a result of use of the tremolo device, after such use has ceased;

Another object of this invention is to provide a tremolo device for a guitar which tremolo device can be used repeatedly without the guitar being detuned as compared to its prior tuning after each use;

Another object of this invention to to provide a method and apparatus as above stated wherein the guitar strings are restrained both at the nut end and at the bridge end;

Another object of this invention is to provide a tremolo device base plate anchor means which allows the tremolo device base plate to tilt properly with relation to the strings and the face of the guitar, but yet return to the original position when not being used;

Another object of this invention is to provide a guitar in combination with a nut and bridge and string restraining assembly wherein the anchor means and the restraining assembly allow appropriate tilting without allowing undesired movement, and causing proper return to original positioning and tensioning of the strings after use of the tremolo device.

The foregoing and other objects and advantages of this invention will become apparent to those skilled in the art upon reading the description of a preferred embodiment which follows, together with a review of the appended drawings.

DESCRIPTION OF A PREFERRED EMBODIMENT

Figures 1, 2, 6, 7, 8:
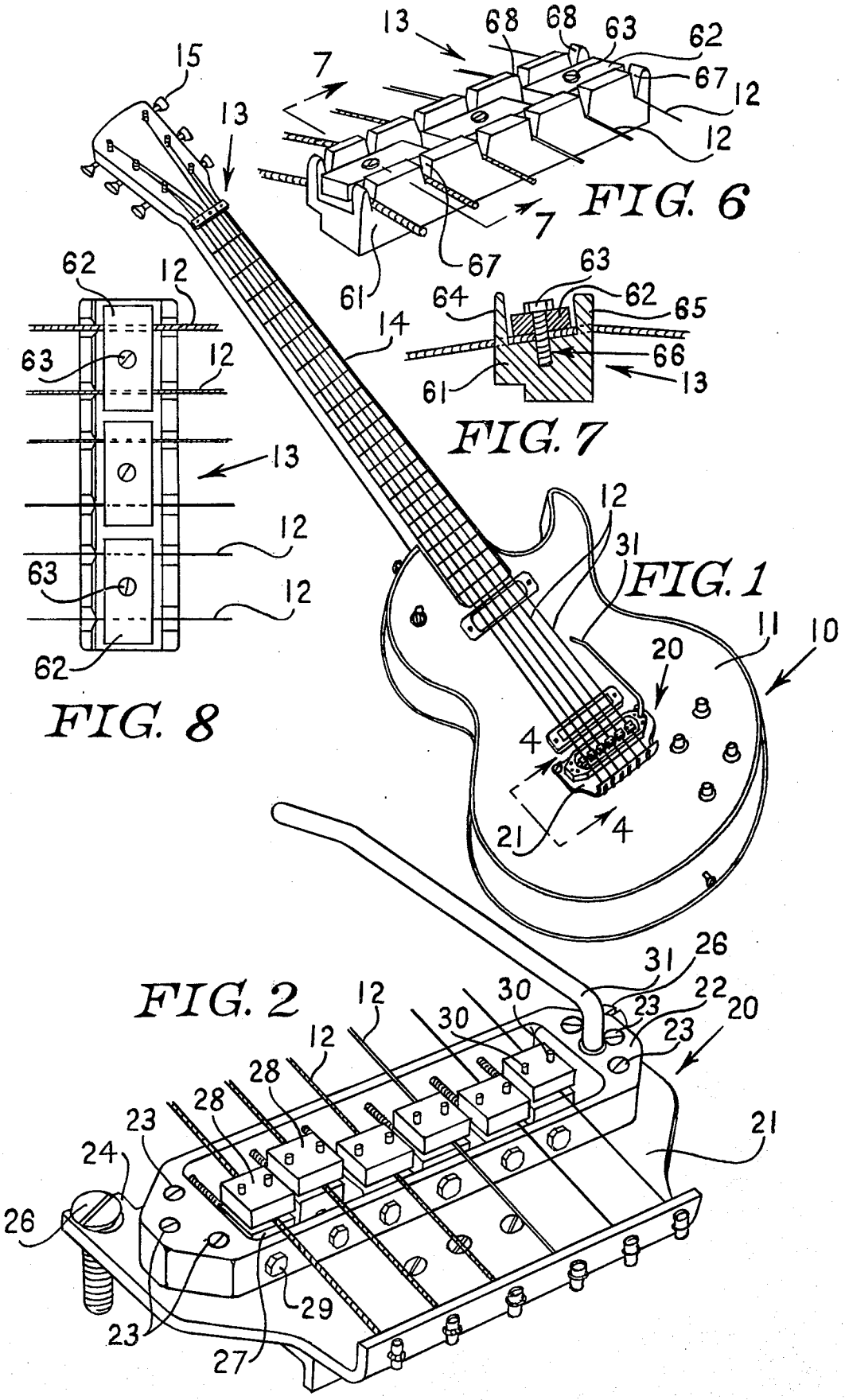
FIG. 1 is a perspective view of a guitar utilizing a preferred embodiment of my invention.
FIG. 2 is an enlarged perspective of a preferred embodiment of the tremolo device base plate and the bridge end string restraining assembly shown generally at 20 on FIG. 1.
FIG. 6 is an enlarged perspective of the nut end string restraining device utilized in the embodiment of FIG. 1.
FIG. 7 is a section on 7—7 of FIG. 6.
FIG. 8 is a top view of the device of FIG. 6.
Figure 4:
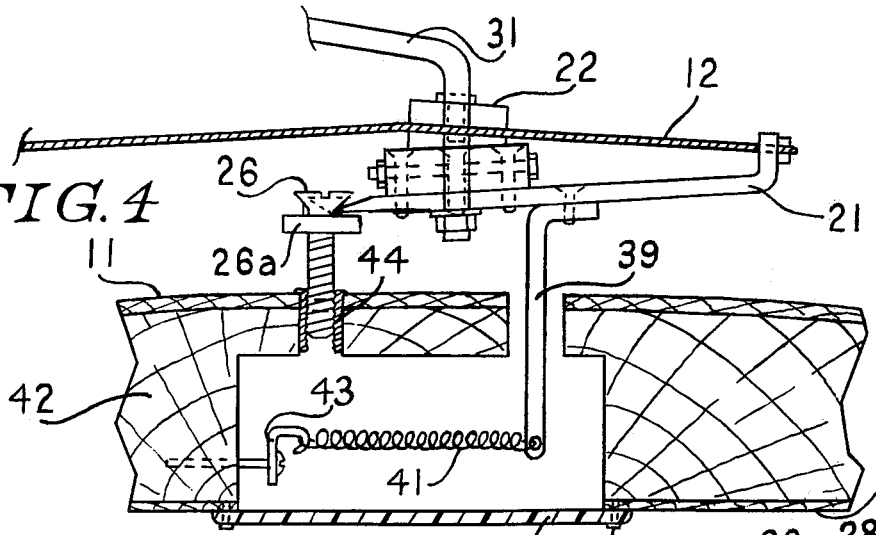
FIG. 4 is an enlarged partial section on 4—4 of FIG. 1.

FIG. 1 should be examined for reference to the general parts of a guitar. The guitar consists of a neck 14, the nut 13 and the body 10 having a sounding board or face 11, and appropriate strings 12 with means 15 to tighten the strings. The particular embodiment shown in FIG. 1 has incorporated a preferred embodiment of my tremolo device 20 and nut end string retaining means.

Turning attention to FIGS. 2, 3, 4 and 5, jointly, the embodiment of an apparatus to perform my method is particularly illustrated in sufficient details for one skilled in the art to construct it. The device comprises a base plate 21, a string restraining and holding means mounting frame 22, string restraining parts of blocks 27 and 28, tremolo anchor screw means 23, tremolo activation lever 31, string end anchor means 40, springs 41, guitar spring anchor means 43, a tremolo device spring arm 39.

Now looking in still more detail it will be seen that the frame 22 may be held in position on the base plate 21 by a series of screws 23, or, of course, if could be attached in any known means or could be integrally formed with base plate 21. Within the opening of the frame, a series of pairs of blocks 27 and 28 are located, each of which is held in pairs and are clamped together by screws 30 which are screwed to tapped holes or the like, by means known to those skilled in the art so that the top plate 28 may be drawn down tight upon, or nearly upon, block 27, and thus have a clamping action upon the string 12. It will be observed that the anchor screw means 26 are located in such a manner that the tremolo device base plate shoulders 24 are held in a tapered slot 25 between the head of screw 26 and flanged shoulder 26*a*. The screws 26 may be screwed into bushings 44 having appropriate threads and appropriately held in a wooden block portion 42 within the body of the guitar as is particularly illustrated at FIG. 4. An opening will be provided as indicated, with a covering plate 46 of plastic or appropriate other material, fastened by screws or the like 47 so that access may be had to this portion if necessary to change strings or otherwise. The spring 41 is held by a screw held anchor 43 or the like as shown, and is appropriately attached by means of holes or the like to spring arm 39 which is fastened beneath the tremolo base plate by screws 38, or by being formed integrally therewith, or by other appropriate means.

Figure 3:
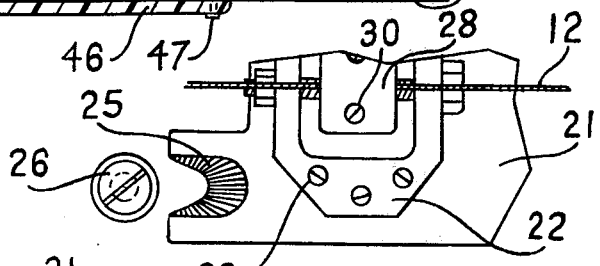
FIG. 3 is a partially exploded partial top view of one device base plate anchor point as utilized in the device of FIG. 2.
Figure 5:
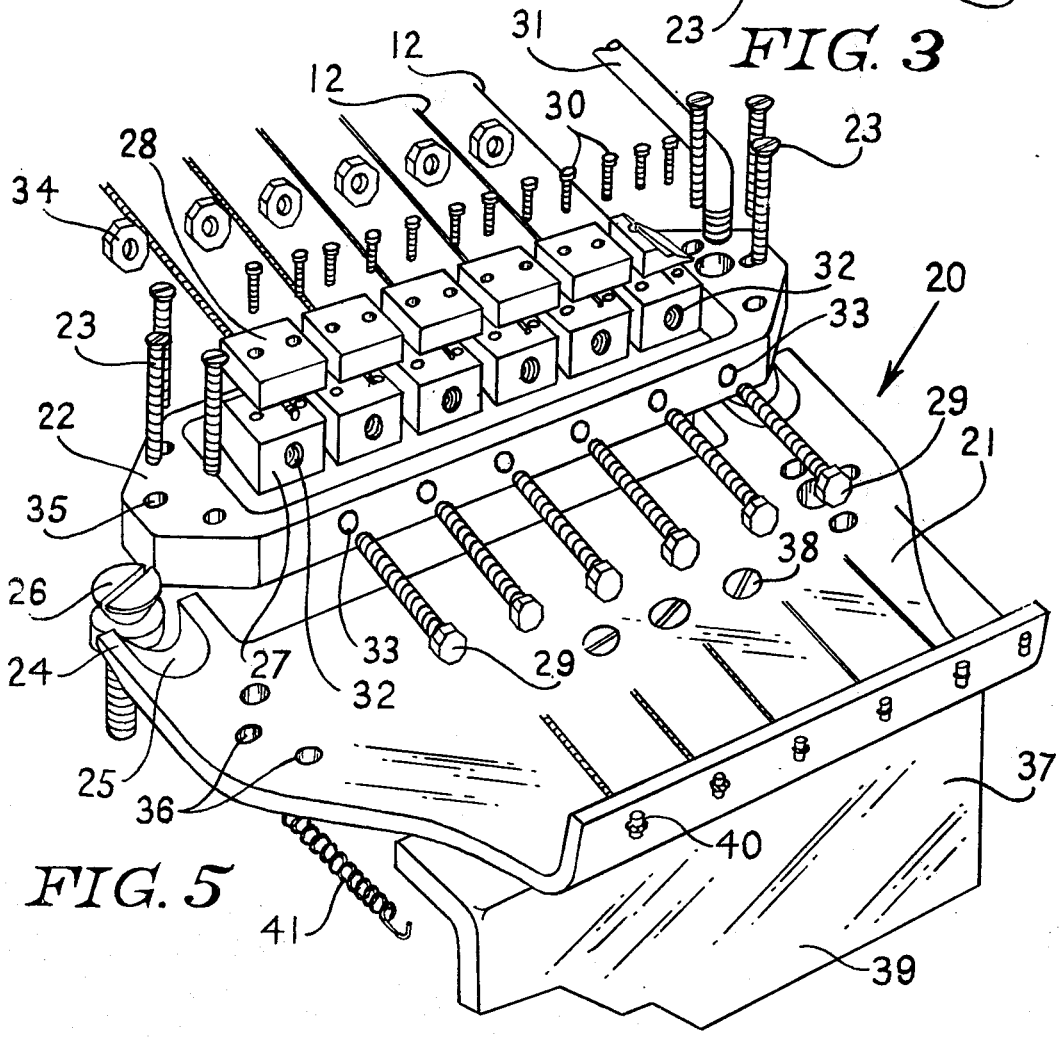
FIG. 5 is an exploded view of the device of FIG. 2.

FIG. 3 particularly illustrates how the tapered slot 25 in shoulder 24 will fit with, and be appropriately held in positive anchor position upon, the screw 26 and between the head of the screw and the flange 26*a*. The tapering slot allows for the tilting motion necessary for the proper activation.

Each block 27 forming a portion of the string locking or restraining mechanism 27–28 is supplied with a threaded hole 32. The screw 29 goes through hole 33 in the frame, and thus the position of the individual block may be altered, and the individual block sets are held in position, by such screw arrangement into the threaded holes 32. The nut 34 will be fastened upon the end of the screws 29 on the other side of the frame than that seen in the views, but by means known to those skilled in the art. One such arrangement can be seen in FIG. 4 wherein the nut is shown in position on one of the screws 29. When fully assembled in this manner, the individual string restraining devices are thus held in a fixed and permanent relationship with relation to the tremolo device and bridge. Each string is futher locked in position by means known to those skilled in the art at 40 on the upturned edge of the tremolo device base plate.

The illustrations so far described in detail explain the complete assembly of the tremolo device and its associated string restraining means and anchor means.

It is important, however, to also have restraining of the strings at the nut 13. An effective and preferred embodiment, which I have developed to utilize here is shown in FIGS. 6, 7, and 8. It will be observed that the string guide and support device 61 at the nut comprises a specially shaped element which could take certain other shapes as far as the angular relations are concerned, but preferrably will have an essentially "U" shaped channel running its length across the neck of the guitar. This device will be appropriately fixed to the guitar by means known to those skilled in the art. A series of matching and aligned slots 67–68 will be provided to accommodate the strings 12. The element 61 will be appropriately drilled and tapped to accommodate screws, or bolts, 63. A series of metal or other suitable rigid blocks 62 will each be drilled at approximately the center position to permit passage of the screw 63 through such block. The block is of the appropriate size to span across two strings 12, and thus, with one screw 63, two strings 12 may be restrained in this position as shown, and as will be clear to those skilled in the art. The block being between the upstanding edges 64 and 65 of the element 61 will be neat and unobtrusive and at the same time will effectively restrain movement of the strings when the bolts, or screws, 63 are tightened into the threaded holes 66 in the element 61.

In use, the guitar will first be tuned as desired, by customary means (15) and while the restraining devices at both ends are loose. When the guitar is completely tuned according to the desired use, the restraining devices at both ends will be tightened so as to maintain the tension between the bridge and the nut at a consistent and proper tension and will not allow sliding of the strings over either the nut or bridge position.

The tremolo arm 31 will frequently be swung out of position so it is out of the way at which point it is swiveled essentially to the outside of the playing area. It will be clear from the views shown that this device does swivel by the screw arrangement having a nut with a washer or the like thereon. When the tremolo device is to be used, the arm 31 is swiveled into the approximate position shown in FIG. 1. At this time, the guitarist may press downwardly upon the arm 31, or may raise upwardly on it. Such action, as will be clear to those skilled in the art, will cause a tilting about the head of the screw 26. The tapered slot arrangement 25 obviously allows for this against the head of the screw 26 and being restrained by the shoulder 27*a*. The tension on the strings, of course, has a tendency to pull the tremolo device tapered slots 25 against the head of the screws 26, and, the spring 41 through the attaching arm 39 has an offsetting tension arrangement holding the tremolo device in such manner that it does not move upward except by the added pressure applied to the arm 31 during activation, and likewise, it will not move downward except when so activated in a downward direction.

The tapering allows for free movement in the tilting direction immediately return to prior tensioning of the strings and initial position together with retention of initial tuning, when the tremolo device is deactivated.

I have illustrated a particular device here, but it is to be understood that many modifications might be made by one skilled in the art and yet utilize the same method and principle explained and taught here. For example, it is conceivable that a ball and socket joint might be used where I have illustrated the tapered slot 25 and screw 26. It is conceivable that one block might restrain two or more strings at the tremolo device itself, and that an individual block, for example, might restrain each individual string at the nut end. These are all minor modifications, which are recognized and the mentioning of some such modifications is not intended to mean that all such modifications are being outlined but only for the purpose of giving examples of modifications which would still fall within the framework of the teaching of this specification. Likewise, other numbers of strings than those shown in the particular embodiment illustrated might exist on one or more guitars without in any manner changing the principles implied and taught. Likewise, the spring might be replaced with an appropriate pneumatic cylinder or the like. Anyone skilled in the art can understand this type of modification.

With all of the modifications possible, however, it is to be pointed out that aside from the general method and principles set forth here I have, in fact, illustrated a very economical and practical and properly working specific mechanism.

While the embodiment of this invention shown and described is fully capable of achieving the objects and advantages desired, it is to be understood that the particular embodiment shown has been for purposes of illustration only, and not for purposes of limitation.

I claim:

1. The method of providing a tremolo device in combination with a guitar comprising the steps of:

(1) affixing anchor means to said guitar in a fixed relationship spaced above the body and sounding board of said guitar;

(2) mounting a tremolo device base plate in association with said anchor means in such manner that the base plate may tilt upon said anchor means;

(3) providing a bridge on said base plate;

(4) providing resilient connection means between the tremolo device base plate and the body of the guitar in such manner that the base plate will be maintained in a fixed position with relation to the body of the guitar except when the tremolo device is activated;

(5) affixing a first restraining means to said bridge to restrain the strings of said guitar; and (6) affixing second restraining means to the nut of the guitar in such a manner as to prevent sliding of the strings with relation to the nut.

2. Guitar tremolo means, in combination with a guitar, comprising:

(1) anchor means mounted on said guitar;

(2) a tremolo base plate means tiltably associated with said anchor means;

(3) bridge means mounted on said base plate;

(4) nut means mounted on the neck of said guitar;

(5) first string restraining means adjustably clamping the strings to said bridge means; and (6) second string restraining means adjustably clamping the strings to said nut means.

3. In combination with a guitar, a tremolo device and string restraining means, comprising:

(1) anchor means comprising two screws, each having an enlarged head and a flange adjacent said head affixed to the face of the guitar at a spaced apart relationship to one another;

(2) tremolo device base plate means comprising an essentially flat plate having two shoulders each of which include an elongated slot with tapered edges, said slots engaging the said screws between the head and flange;

(3) means connected to said base plate to enable the same to be tilted with relationship to the said anchor screws;

(4) a bridge located on said base plate, said bridge having a pair of blocks clamping at least one string of the guitar to said bridge;

(5) string restraining means comprising a clamping block holding said at least one string in fixed relationship upon the nut of the guitar; and (6) spring return means suitable to return the tremolo device base plate to its initial position after each use.

* * * * *